US011236707B2

(12) United States Patent
Ito

(10) Patent No.: US 11,236,707 B2
(45) Date of Patent: Feb. 1, 2022

(54) LEAKAGE DETECTOR FOR FUEL VAPOR TREATMENT DEVICE

(71) Applicant: AISAN KOGYO KABUSHIKI KAISHA, Obu (JP)

(72) Inventor: Yuzuru Ito, Chiryu (JP)

(73) Assignee: Aisan Kogyo Kabushiki Kaisha

( * ) Notice: Subject to any disclaimer, the term of this patent is extended or adjusted under 35 U.S.C. 154(b) by 0 days.

(21) Appl. No.: 17/019,533

(22) Filed: Sep. 14, 2020

(65) Prior Publication Data

US 2021/0095620 A1 Apr. 1, 2021

(30) Foreign Application Priority Data

Sep. 26, 2019 (JP) ..... JP2019-175551

(51) Int. Cl.
*F02M 25/08* (2006.01)

(52) U.S. Cl.
CPC .... *F02M 25/0818* (2013.01); *F02M 25/0836* (2013.01); *F02M 25/0872* (2013.01); *F02M 2025/0845* (2013.01)

(58) Field of Classification Search
CPC ..... F02M 25/0818; F02M 25/0872; F02M 25/0836; F02M 2025/0845; F02M 25/0809
See application file for complete search history.

(56) References Cited

U.S. PATENT DOCUMENTS 10,294,895 B2 5/2019 Shirai
2016/0017849 A1* 1/2016 Shirai ..... F02M 35/10222 123/520

FOREIGN PATENT DOCUMENTS

JP 2010071198 A 4/2010
JP 2016020675 A 2/2016

* cited by examiner

*Primary Examiner* — Xiao En Mo
(74) *Attorney, Agent, or Firm* — Conley Rose, P.C.

(57) ABSTRACT

A leakage detector for a fuel vapor treatment device includes a control unit. The control unit shifts a purge control valve and a shutoff valve to a first state with the purge control valve is an opened position and the shutoff valve in a closed position, and then shifts the purge control valve and the shutoff valve to a second state with the purge control valve is a closed position and the shutoff valve in a closed position. The control unit compares a first purge passage pressure acquired from the purge passage pressure detector when the purge control valve and the shutoff valve were shifted to the second state with a second purge passage pressure acquired from the purge passage pressure detector after a lapse of a first waiting time after being shifting to the second state. This comparison is used to determine leakage in the purge passage.

4 Claims, 4 Drawing Sheets

LEAKAGE DETECTOR FOR FUEL VAPOR TREATMENT DEVICE

CROSS-REFERENCE TO RELATED APPLICATIONS

This application claims priority to Japanese patent application serial number 2019-175551, filed Sep. 26, 2019, the contents of which is hereby incorporated herein by reference in its entirety for all purposes.

BACKGROUND

Embodiments disclosed herein relate to leakages detector for fuel vapor treatment devices.

Some fuel vapor treatment devices for a vehicle, such as an automobile, may include a canister filled with an adsorbent capable of adsorbing and desorbing a fuel vapor. The fuel vapor generated in a fuel tank is adsorbed by the adsorbent in the canister. The fuel vapor adsorbed by the adsorbent is desorbed to a purge passage when the vehicle is running, that is, when the internal combustion engine is operating. The desorbed fuel vapor is supplied to an intake passage leading to the internal combustion engine.

SUMMARY

In accordance with an aspect of the present disclosure, a first means may include a leakage detector for a fuel vapor treatment device comprising a canister and a purge passage connecting a purge port of the canister and an intake passage. The leakage detector may include a shutoff valve disposed in the purge passage, a purge control valve disposed in the purge passage closer to the side of the intake passage than the shutoff valve, a purge passage pressure detector disposed in the purge passage between the shutoff valve and the purge control valve, and a control unit configured to determine the leakage in the purge passage. The control unit may shift the purge control valve and the shutoff valve to a first state where the purge control valve is opened and the shutoff valve is closed. Then, the control unit may shift the purge control valve and the shutoff valve to a second state where the shutoff valve and the purge control valve are both closed. Then, the control unit may compare a first purge passage pressure with a second purge passage pressure. The first purge passage pressure may be a pressure acquired from the purge passage pressure detector after the purge control valve and the shutoff valve are shifted from the first state to the second state. The second purge passage pressure may be a pressure acquired from the purge passage pressure detector after a predetermined time has lapsed since the purge control valve and the shutoff valve are shifted to the second state. In the comparison, if the second purge passage pressure is higher than the first purge passage pressure by a predetermined amount or more, leakage in the purge passage is determined.

According to the first means, even if a leakage occurs in the purge passage, before or after the leakage has been determined, fuel vapor may not be released to the outside air or only a slight amount of fuel vapor may be released to the outside air. That is, it may reduce and/or prevent fuel from leaking when determining leakage of the fuel vapor.

In accordance with another aspect of the present disclosure, a second means may be the leakage detector for the fuel vapor treatment device according to the first means, wherein the control unit may shift the purge control valve and the shutoff valve to the first state again when the second purge passage pressure is higher than the first purge passage pressure by a predetermined amount or more in the comparison. Then, the control unit may shift the purge control valve and the shutoff valve back to the second state.

According to the second means, after the control unit determined the leakage, the purge passage may be suctioned. Then, the shutoff valve and the purge control valve may be shifted to the second state. As a result, even if a leakage occurs in the purge passage, fuel vapor may not be released to the outside air, or only a slight amount of fuel vapor may be released to the outside air.

In accordance with another aspect of the present disclosure, a third means may be the leakage detector for the fuel vapor treatment device according to the first means, wherein the predetermined amount may include a first predetermined amount and a second predetermined amount. The second predetermined amount may be smaller than the first predetermined amount. In the comparison, the control unit may shift the purge control valve and the shutoff valve to the first state again when the second purge passage pressure is higher than the first purge passage pressure by the first predetermined amount or more. The control unit may then shift the purge control valve and the shutoff valve to the second state. Also, in the comparison, the control unit may shift the purge control valve and the shutoff valve to a third state when the second purge passage pressure is not higher than the first purge passage pressure by the first predetermined amount or more, but is still higher than the first purge passage pressure by the second predetermined amount or more. The third state may a state where the purge control valve and the shutoff valve are both opened.

According to the third means, when leakage occurs in the purge passage, appropriate measures may be taken depending on the degree of the leakage.

In accordance with another aspect of the present disclosure, a fourth means may be the leakage detector for the fuel vapor treatment device according to the first means, further comprising an intake passage pressure detector disposed in the intake passage. The control unit may compare the intake passage pressure with a third purge passage pressure after shifting the purge control valve and the shutoff valve to the first state, but before shifting to the second state. The intake passage pressure may be the pressure acquired from the intake passage pressure detector. The third purge passage pressure may be the pressure acquired from the purge passage pressure detector. When the third purge passage pressure is higher than the intake passage pressure by an allowable value or more, leakage in the purge passage may be determined, without performing the comparison between the first purge passage pressure and the second purge passage pressure.

According to the fourth means, when the degree of leakage in the purge passage is high (the amount of leakage is large), the leakage may be specified immediately.

According to the above-described means, the leak detector of the fuel vapor treatment device may not release fuel vapor to the outside air or release only a slight amount of fuel vapor to the outside air when performing leakage detection of the purge passage.

DETAILED DESCRIPTION

As previously described, fuel vapor adsorbed by the adsorbent is desorbed to a purge passage when the vehicle is running. A purge pipe, defining the purge passage therein, is typically disposed on the lower surface of the vehicle that faces the road surface. Consequently, the purge pipe may be damaged by pebbles or the like that bounce upward from the road surface. In some cases, the damage may result in a leak along purge passage. In such a case, there may be an abnormality detection device that detects the leakage in the purge passage. In response to detection of the leak by the abnormality detection device, a purge pump is operated to generate flow from the canister toward the intake passage. Accordingly, if there is a leak in the purge passage, the fuel vapor may be inadvertently released to the outside air during the detection process.

An object of the present disclosure is to provide a leakage detector for a fuel vapor treatment device, which does not release fuel vapor to the outside air or releases only a relatively small amount of fuel vapor to the outside air when detecting a leakage in the purge passage.

Embodiments of leakage detectors for the fuel vapor treatment devices to address the foregoing problems will now be described.

Figure 1:
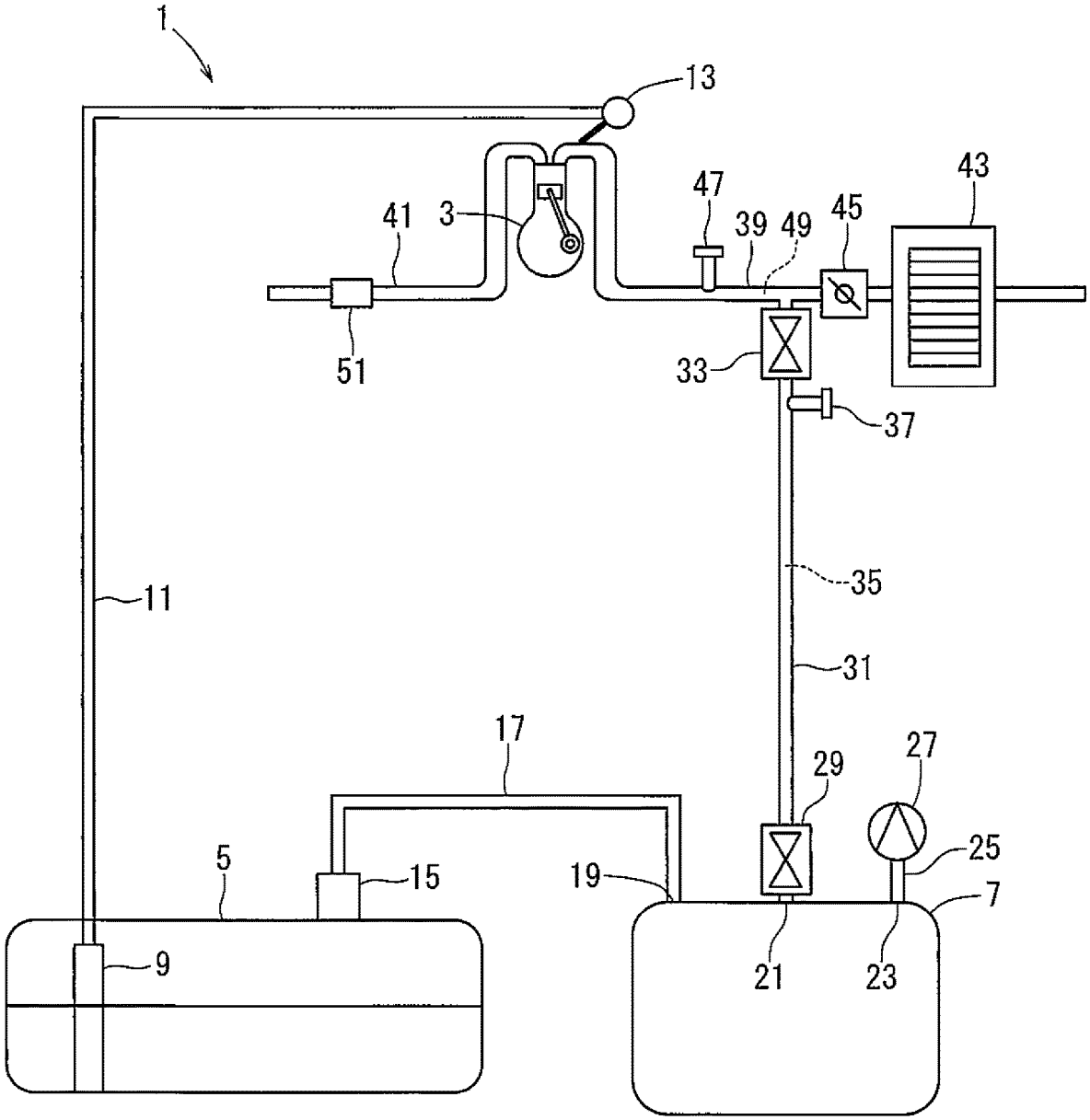
FIG. 1 is a schematic view of a fuel vapor treatment device of a vehicle including a leakage detector according to a first embodiment.

An embodiment will be described with reference to FIGS. 1 to 4. FIG. 1 shows a fuel vapor treatment device 1 that may be mounted on a vehicle, such as an automobile. The fuel vapor treatment device 1 includes an internal combustion engine 3 (engine), a fuel tank 5 that stores fuel (gasoline) to be supplied to the internal combustion engine 3, and a canister 7 filled with an adsorbent that adsorbs and desorbs fuel vapor(s) generated in the fuel tank 5. The fuel stored in the fuel tank 5 can be pumped by a fuel pump 9 housed in the fuel tank 5 to supply fuel to the internal combustion engine 3 via a fuel supply pipe 11 and an injector 13.

A cutoff valve 15 is positioned on the upper wall of the fuel tank 5. The cutoff valve 15 is disposed at one end of a vapor pipe 17. The other end of the vapor pipe 17 is connected to a vapor port 19 of the canister 7. As a result, the fuel vapor generated in the fuel tank 5 can be introduced into the canister 7 via the vapor pipe 17.

In addition to the vapor port 19 described above, the canister 7 includes a purge port 21 and an atmosphere port 23. A purge pump 27 is connected to the atmosphere port 23 via a connecting pipe 25. An inlet of the purge pump 27 is open to the surrounding atmosphere, and the outlet is connected to the connecting pipe 25. The operation of the purge pump 27 is controlled by an Engine Control Unit (ECU) 62, described later with reference to FIG. 2. One end of a purge pipe 31 is connected to the purge port 21 via a shutoff valve 29 (also referred to as "SV" in the Drawings). The shutoff valve 29 is positioned near the purge port 21. The other end of the purge pipe 31 is connected to an intake pipe 39, described in more detail below, via a purge control valve 33 (also referred to as "PCV" in the Drawings). The purge control valve 33 is positioned near the intake pipe 39. The shutoff valve 29 and the purge control valve 33 are are electromagnetic valves, which open and close in response to input signal(s) from the ECU 62. A purge passage 35 is defined within the purge pipe 31. A purge passage pressure sensor 37 (also referred to as "PPPS" in the Drawings) is disposed on the purge pipe 31. The purge passage pressure sensor 37 measures the pressure in the purge passage 35, and outputs and communicates an electric signal indicating the measured pressure to the ECU 62. An example of the purge passage pressure sensor 37 may be a semiconductor diaphragm type sensor that converts a change in resistance of a piezoresistive element positioned on the diaphragm into an electric signal. The purge passage pressure sensor 37 may correspond to the purge passage pressure detector in the present disclosure.

One end of each of the intake pipe 39 and an exhaust pipe 41 are connected to the internal combustion engine 3. The other end of each of the intake pipe 39 and the exhaust pipe 41 are open to the surrounding atmosphere. An air cleaner 43, a throttle valve 45, and an intake passage pressure sensor 47 (also referred to as "IPPS" in the Drawings) are disposed along the intake pipe 39, in order from the side of the atmosphere toward the side of the internal combustion engine 3. The throttle valve 45 is electronically controlled by the ECU 62, so that the opening and closing amount of the throttle valve can be adjusted according to the operation of an accelerator pedal (not shown). The intake passage pressure sensor 47 measures the pressure of an intake passage 49 within the intake pipe 39 and outputs and communicates an electric signal indicating the measured pressure to the ECU 62. The intake passage pressure sensor 47 may be of the same type as the purge passage pressure sensor 37, or may be of a different type. The part of the intake pipe 39 to which the purge control valve 33 is connected is located between the throttle valve 45 and the intake passage pressure sensor 47. A catalytic converter 51 is positioned along the exhaust pipe 41. The intake passage pressure sensor 47 may correspond to the intake passage pressure detector in the present disclosure.

The fuel vapor adsorbed by the adsorbent in the canister 7 is desorbed from the adsorbent due to the dynamic pressure generated by the purge pump 27 and/or the negative pressure generated by the intake passage 49 due to the internal combustion engine 3. Then, the fuel vapor flows to the internal combustion engine 3 via the purge passage 35. Therefore, normally, the shutoff valve 29 and the purge control valve 33 are open when the vehicle is travelling.

Figure 2:
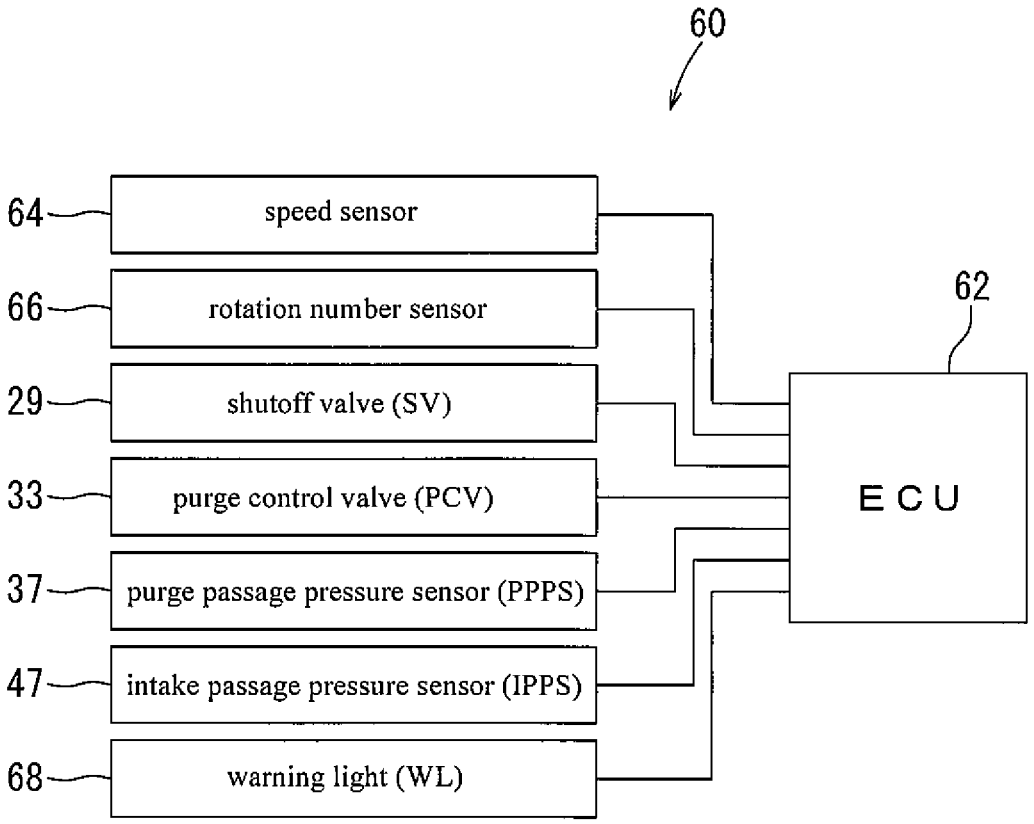
FIG. 2 is a schematic block diagram illustrating the leakage detector of FIG. 1.

The configuration of a leakage detector 60 will be described with reference to FIG. 2. The leakage detector 60 may be part of the electric control system of the vehicle including an ECU 62 and electronic devices electrically and communicatively coupled to the ECU 62 via electrical wiring. In this embodiment, the electronic devices include the shutoff valve 29, the purge control valve 33, the purge passage pressure sensor 37, and the intake passage pressure sensor 47 as previously described. In addition, the electronic devices include a speed sensor 64, a rotation number sensor 66, and a warning light 68 (also referred to as "WL" in the Drawings). The speed sensor 64 measure the traveling speed of the vehicle, and outputs and communicates signal(s) indicating the speed to the ECU 62. The rotation number sensor 66 measures the rotation number of the internal combustion engine 3, and outputs and communicates signal (s) indicating the rotation number to the ECU 62. The warning light 68 may be, for example, an LED (Light Emitting Diode), and are turned on and off according to a control signal from the ECU 62. The ECU 62 may make various determinations during a leakage detection process, described in more detail below, based on input signals from the speed sensor 64, the rotation number sensor 66, the purge passage pressure sensor 37, and the intake passage pressure sensor 47. Then, the ECU 62 controls the shutoff valve 29, the purge control valve 33, and the warning light 68 according to the determinations.

Figure 3:
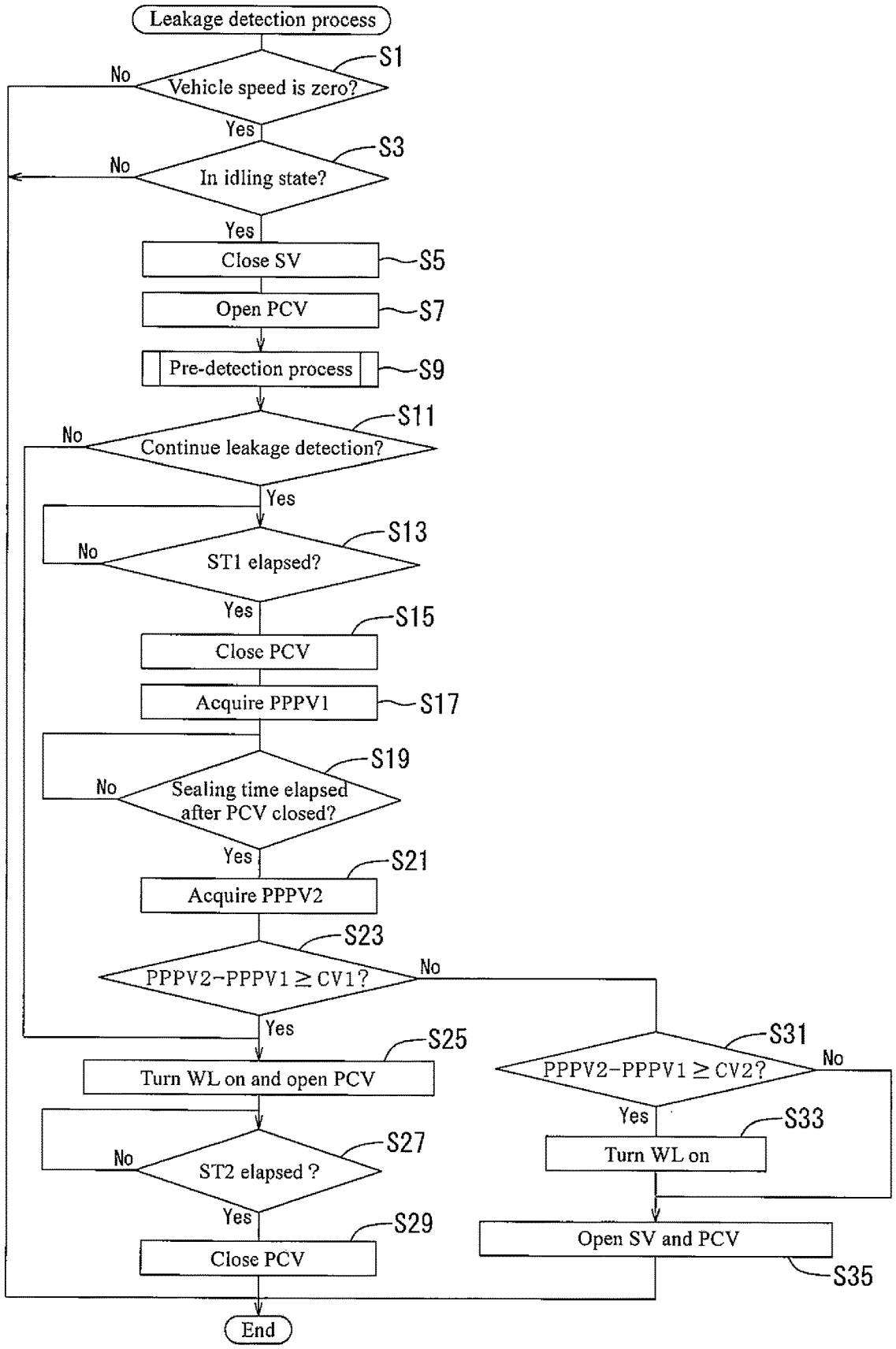
FIG. 3 is a flowchart illustrating a method for operating the leakage detector of FIG. 2.
Figure 4:
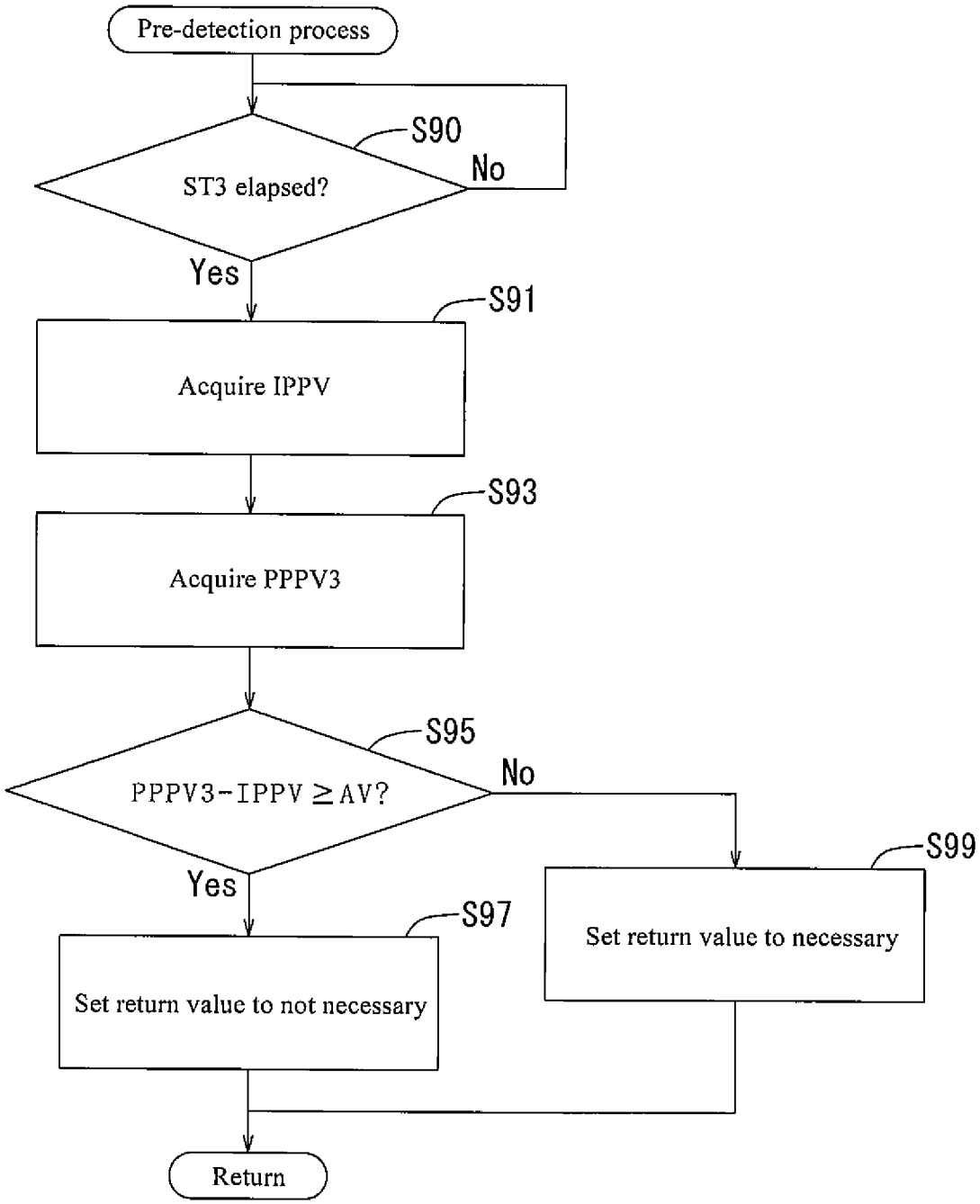
FIG. 4 is a flowchart illustrating a method for operating the leakage detector of FIG. 2.

With reference to FIGS. 3 and 4, a leakage detection process will be described in the order of a main routine (FIG. 3) and a subroutine (FIG. 4). The leakage detection process may be executed repeatedly, for instance, at predetermined time intervals while the electric control system of the vehicle is operating. In the leakage detection process, a leak in the purge passage 35, which may have occurred due to damage to the purge pipe 31 or the like, is detected. The degree of leakage may differ depending on the degree of the damage to the purge pipe 31. In the present embodiment, the leakage in the purge passage 35 may be specified, and appropriate control may be performed according to the degree of leakage.

Initially, the ECU 62 determines whether the vehicle speed is zero, for instance, based on the input signal from the speed sensor 64 (S1). When the vehicle speed is zero (Yes at S1), the process proceed to S3. When the vehicle speed is not zero (No at S1), the leakage detection process may end. At S3, the ECU 62 determines whether the vehicle is in the idling state, for instance, based on the input signal from the rotation number sensor 66 (S3). When the vehicle is in the idling state (Yes at S3), the process proceed to S5. When the vehicle is not in the idling state (No at S3), the leakage detection process may end. Note that it is preferable that the leakage detection process continue only when the engine is idling. The reason is that the pressure of the intake passage 49 is lower than atmospheric pressure in the idling state, so that the purge passage 35 may be sufficiently suctioned in the subsequent step(s), even if the purge pump 27 is not operating. Although not intended to be limiting, in general, the purge pump 27 is not operating or is operating at a very low speed in the idling state.

At S5, the ECU 62 closes the shutoff valve 29 (S5), then opens the purge control valve 33 (S7). Then, the process proceeds to S9. The state, which may exist immediately after S7, where the shutoff valve 29 is in the closed state and the purge control valve 33 is in the open state may also be referred to herein as a "first state" in the present disclosure. At S9, a subroutine corresponding to a pre-detection process may be performed, an embodiment of which will be described in greater detail below in connection with FIG. 4. If the pre-detection process indicates it is necessary, at the steps after S11 of the main routine, the purge passage 35 is suctioned by the negative pressure of the intake passage 49 while keeping the shutoff valve 29 and the purge control valve 33 in the first state. After that, the shutoff valve 29 and the purge control valve 33 are shifted to a second state where both valves are closed. Then, the leakage detection is performed in the second state. However, for example, when a very large hole is formed in the purge pipe 31, the leakage may be detected at a subroutine of the pre-detection process, without executing the steps after S11 of the main routine. When each step executed at the subroutine S9 is completed, the decision whether it is necessary to continue the leakage detection may be passed to the main routine as a return value. Then, at S11, the ECU 62 determines whether to continue the leakage detection based on the return value (S11). When the ECU 62 determines it is necessary to continue the leakage detection (Yes at S11), the process proceeds to S13. When the ECU 62 determines that it is not necessary to continue the leakage detection (No at S11), the process proceeds to S25.

At S13, when a first suction time (also referred to as "ST1" in the Drawings) has not elapsed after the purge control valve 33 was opened at S7 (No at S13), the ECU 62 waits until the first suction time is elapsed. After the first suction time has elapsed (Yes at S13), the process proceeds to S15. At S15, the ECU 62 closes the purge control valve 33 (S15). That is, immediately after S15, the shutoff valve 29 and the purge control valve 33 are in the second state. The first suction time may be set to, for example, 200 ms. At S13, the process waits until the first suction time has elapsed; then the process may proceed to S15. The shutoff valve 29 and the purge control valve 33 are allowed to be in the second state after the purge passage 35 has been suctioned for a certain period of time. The first suction time may correspond to the predetermined time in the present disclosure.

After S15, the ECU 62 proceeds to S17. The ECU 62 acquires a signal indicating a pressure value from the purge passage pressure sensor 37. The ECU 62 stores the pressure value indicated by the signal in a storage area as a first purge passage pressure value (S17) (also referred to as "PPPV1" in the Drawings). Then, the process proceeds to S19. At S19, when a sealing time has not elapsed after the purge control valve 33 was closed at S15 (No at S19), the ECU 62 waits until the sealing time has elapsed. After the sealing time has elapsed (Yes at S19), the process proceeds to S21. The sealing time may be set to, for example, 2 seconds. At S21, the ECU 62 acquires a signal indicating the pressure value from the purge passage pressure sensor 37. The ECU 62 stores the pressure value indicated by the signal in the storage area as a second purge passage pressure value (S21) (also referred to as "PPPV2" in the Drawings). Then, the process then proceeds to S23.

When a leakage occurs in the purge passage 35, it is expected that the pressure in the purge passage 35 will increase, up to atmospheric pressure, during the sealing time. Therefore, at S23, the ECU 62 determines whether a second purge passage pressure value is higher than a first purge passage pressure value by a first comparison value (also referred to as "CV1" in the Drawings) or more (S23). The first comparison value may be set to, for example, 10 to 20 kPa. When the determination at S23 is affirmative (Yes at S23), the process proceeds to S25. When the determination at S23 is negative (No at S23), the process proceeds to S31. The first comparison value may correspond to the predetermined amount or the first predetermined amount in the present disclosure. Further, at S23, the determination of Yes by the ECU 62 may correspond to the specification of the leakage in the purge passage by a control unit of the present disclosure.

At S25, the ECU 62 opens the purge control valve 33 and turns on the warning light 68 (S25). That is, at S25, the shutoff valve 29 and the purge control valve 33 are shifted to the first state. Then, the process proceeds to S27. At S27, after having opened the purge control valve 33 at S25, the ECU 62 waits until the second suction time (also referred to as "ST2" in the Drawings) has elapsed (No at S27). When the second suction time has elapsed (Yes at S27), the process proceeds to S29. At S29, the ECU 62 closes the purge control valve 33 (S29). That is, at S29, the shutoff valve 29 and the purge control valve 33 are shifted to the second state. The second suction time may preferably be longer than the first suction time, and may be, for example, set to 1 second.

S25, S27, and S29 may be executed for at least the following reasons. At the step (S23) immediately before S25, a leakage in the purge passage 35 may be specified. Therefore, it may be desirable to notify passenger(s) in the vehicle of the leakage in the purge passage 35. Thus, the warning light 68 may be turned on at S25.

At S27, the inside of the purge passage 35 is suctioned by the negative pressure of the intake passage 49 for the second suction time, which may be longer than the first suction time. As a result, the fuel vapor in the purge passage 35, which may not have been sufficiently suctioned at S13, is sufficiently removed. Therefore, and thereafter, the fuel vapor does not leak from the purge passage 35 at all, or only a slight amount of the fuel vapor may leak from the purge passage 35.

Again, returning to the description with reference to the flowchart, at S31, the ECU 62 determines whether the second purge passage pressure value is higher than the first purge passage pressure value by a second comparison value (also referred to as "CV2" in the Drawings) or more (S31). The second comparison value may be a value smaller than the first comparison value. The second comparison value may be set to, for example, 5 to 10 kPa. When the determination at S31 is affirmative (Yes at S31), the process proceeds to S33. When the determination at S31 is negative (No at S31), the process proceeds to S35. At S33, the ECU 62 turns on the warning light 68 (S33), then the process proceeds to S35. At S35, the ECU 62 opens the shutoff valve 29 and the purge control valve 33 (S35). The state where the shutoff valve 29 and the purge control valve 33 are in the open state may be referred to as a third state in the present disclosure. The second comparison value may correspond to the predetermined amount or the second predetermined amount in the present disclosure. At S31, a determination of Yes by the ECU 62 may correspond to the specification of the leakage in the purge passage by the control unit in the present disclosure.

S31, S33, and S35 may be executed for at least the following reasons. A leakage in the purge passage 35 was specified by the determinations at S23 and S31. Therefore, as was the case where S23 is affirmative, the warning light 68 may be turned on, with the intention of informing the passenger(s) in the vehicle of the leakage in the purge passage 35 (S33). However, if the determination at S23 was negative, the degree of leakage in the purge passage 35 may not be as serious as in the case where the determination at S23 was affirmative. That is, the degree of leakage may be relatively low. Therefore, during the period of time before the purge pipe 31 may be repaired, similar to the case where no leak occurs in the purge passage 35, it may be considered that the influence on supplying the fuel vapor to the intake passage 49 via the purge passage 35 may be relatively small. For at least the above reason, S31, S33, and S35 may be executed.

Again, returning to the description with reference to the flowchart, each step executed at the subroutine, corresponding to the pre-detection processing of S9, will be described with reference to FIG. 4. At S90, when the third suction time (also referred to as "ST3" in the Drawings) has not elapsed after the purge control valve 33 has opened at S7 (No at S90), the ECU 62 waits until the third suction time has elapsed. After the third suction time as elapsed (Yes at S90), the process proceeds to S91. At S91, the ECU 62 acquires a signal indicating the pressure value from the intake passage pressure sensor 47. The pressure value indicated by the signal is stored in the storage area as the intake passage pressure value (also referred to as "IPPV" in the Drawings) (S91). Then, the process proceeds to S93. At S93, the ECU 62 acquires a signal indicating the pressure value from the purge passage pressure sensor 37. The pressure value indicated by the signal is stored in the storage area as the third purge passage pressure value (also referred to as "PPPV3" in the Drawings) (S93). Then, the process proceeds to S95. At S95, the ECU 62 determines whether the third purge passage pressure value is higher than the intake passage pressure value by an allowable value (also referred to as "AV" in the Drawings) or more (S95). The third suction time may be shorter than the first suction time. The third suction time may be, for example, set to 100 ms. The allowable value may be, for example, set to 10 to 20 kPa.

At S95, when the determination is affirmative (Yes at S95), the ECU 62 proceeds to S97. At S97, the ECU 62 sets the return value indicating that it is not necessary to continue the leakage detection (S97), and returns to the main routine. On the other hand, at S95, when the determination is negative (No at S95), the ECU 62 proceeds to S99. At S99, the ECU 62 sets the return value indicating that it is necessary to continue the leakage detection (S99), and returns to the main routine.

The pre-detection processing subroutine may be executed for at least the following reasons. For example, if a very large hole is formed in the purge pipe 31, a large amount of outside air may flow into the purge passage 35 during suction. Therefore, the pressure in the purge passage 35 may not be sufficiently reduced during S13, even if the suction may be executed using the negative pressure of the intake passage 49. That is, when a large hole is formed in the purge pipe 31, the pressure in the purge passage 35 and the pressure in the intake passage 49 may still have a large difference, even if the shutoff valve 29 and the purge control valve 33 are keep in the first state for a predetermined time (in the present embodiment, keep in the state for the third suction time). Therefore, when the intake passage pressure value and the third purge passage pressure value are compared, and the difference is equal to or larger than the allowable value, it may be determined that a large hole exists. Further, when a large hole is specified at the pre-detection process, it may not be necessary to detect a leakage in the purge passage 35 thereafter. As described above, at S11 of the main routine, the ECU 62 determines whether the return value indicates that further leak detection is necessary. Then, the ECU 62 may switch between subsequent processes based on the determination.

In the present embodiment, the shutoff valve 29 and the purge control valve 33 are first be moved to the first state, and then moved to the second state where both valves are closed. Then, the ECU 62 compares the first purge passage pressure value with the second purge passage pressure value. The first purge passage pressure value is the pressure acquired from the purge passage pressure sensor 37 when the state shifts to the second state. The second purge passage pressure value is the pressure acquired from the purge passage pressure sensor 37 after the first waiting time has elapsed since, the time since the state shifted to the second state. Then, in the comparison, a leakage in the purge passage 35 is determined if the second purge passage pressure value is higher than the first purge passage pressure value by the first comparison value or the second comparison value or more. The leakage detection may be executed by setting the pressure of the purge passage 35 at a pressure lower than atmospheric pressure, that is, a so-called negative pressure. Therefore, even if a hole or the like was formed in the purge pipe 31 and leakage was occurring in the purge passage 35, at least during the leakage detection process of the present embodiment, fuel vapor may not be released to the outside air, or only a relatively small amount of the fuel vapor may be released to the outside air.

Further, the above process may be executed when the vehicle is in the idling state. Therefore, it is not necessary to operate the purge pump 27 because the negative pressure of the intake passage 49 may generate sufficient suction the purge passage 35.

Further, in the above comparison, when the second purge passage pressure value is higher than the first purge passage pressure value by the first comparison value or more, the shutoff valve 29 and the purge control valve 33 are shifted to the first state again. Then, the state is shifted to the second state after the second waiting time has elapsed. As a result, the fuel vapor in the purge passage 35 is sufficiently removed. Then, and thereafter, even if there is a leakage in the purge passage 35, fuel vapor may not leak from the purge passage 35 at all, or only a relatively small amount of fuel vapor may leak from the purge passage 35.

Further, in the above comparison, when the second purge passage pressure value is not higher than the first purge passage pressure value by the first comparison value or more and is higher by the second comparison value or more, the shutoff valve 29 and the purge control valve 33 are shifted to the third state. Therefore, appropriate measures may be taken depending on the degree of the leakage, when there is a leakage in the purge passage 35.

In addition, the leakage in the purge passage 35 may be determined without executing the comparison between the first purge passage pressure value and the second purge passage pressure value when the third purge passage pressure value is higher than the intake passage pressure value by the allowable value or more. Thus, if a large hole is formed in the purge pipe 31, the leakage can be determined quickly.

The leakage detection device disclosed in the present disclosure is not limited to the above-described embodiment, and may be modified in other forms. In the above embodiment, a leakage in the purge passage 35 is determined using the first comparison value and the second comparison value. However, it may be configured to use only the first comparison value. In this case, the above embodiment is modified as follows. For instance, when the determination at S23 is negative, S31 and S33 may be omitted, and the process may proceed to S35. Even if the leakage detector is configured in this way, and even if a hole or the like is formed in the purge pipe 31 such that leakage would occur in the purge passage 35, before and after the leakage is determined, the fuel vapor may not be released to the outside air, or only a relatively small amount of the fuel vapor may be released to the outside air.

Moreover, in some embodiments, the pre-detection process may be omitted. In this case, the above embodiment is modified such that S9 and S11 are omitted after S7, and the process may proceed to S13.

In the above embodiment, the inlet of the purge pump 27 is open to the atmosphere, and the outlet is connected to the atmosphere port 23 via the connecting pipe 25. However, the purge pump 27 may be positioned along the purge passage 35. In this case, it is preferable that the ECU 62 stop the purge pump 27 at the timing between S3 and S5.

The various examples described above in detail with reference to the attached drawings are intended to be representative of the present disclosure and are thus non-limiting embodiments. The detailed description is intended to teach a person of skill in the art to make, use, and/or practice various aspects of the present teachings, and thus does not limit the scope of the disclosure in any manner. Furthermore, each of the additional features and teachings disclosed above may be applied and/or used separately or with other features and teachings in any combination thereof, to provide an improved leakage detector for fuel vapor treatment devices, and/or methods of making and using the same.

What is claimed is:

1. A leakage detector for a fuel vapor treatment device, comprising:

a canister including a purge port;

a purge passage connecting the purge port of the canister and an intake passage;

a shutoff valve disposed along the purge passage, wherein the shutoff valve has an opened position and a closed position;

a purge control valve disposed along the purge passage between the intake passage and the shutoff valve, wherein the purge control valve has an opened position and a closed position;

a purge passage pressure detector disposed along the purge passage between the shutoff valve and the purge control valve; and a control unit configured to determine a leakage in the purge passage, wherein:

the control unit is configured to shift the purge control valve and the shutoff valve to a first state with the purge control valve in the opened position and the shutoff valve in the closed position;

the control unit is configured to shift the purge control valve and the shutoff valve from the first state to a second state with the shutoff valve in the closed position and the purge control valve in the closed position;

the control unit is configured to compare a first purge passage pressure acquired from the purge passage pressure detector after the purge control valve and the shutoff valve are shifted from the first state to the second state, with a second purge passage pressure acquired from the purge passage pressure detector after a predetermined time after the purge control valve and the shutoff valve are shifted to the second state; and the control unit is configured to determine the leakage in the purge passage when the second purge passage pressure is higher than the first purge passage pressure by a predetermined amount or more based on the comparison.

2. The leakage detector for the fuel vapor treatment device according to claim 1, wherein:

the control unit is configured to shift the purge control valve and the shutoff valve to the first state when the second purge passage pressure is higher than the first purge passage pressure by the predetermined amount or more in the comparison; and the control unit is configured to then shift the purge control valve and the shutoff valve to the second state.

3. The leakage detector for the fuel vapor treatment device according to claim 1, wherein:

the predetermined amount includes a first predetermined amount and a second predetermined amount that is smaller than the first predetermined amount;

the control unit is configured to shift the purge control valve and the shutoff valve to the first state when the second purge passage pressure is higher than the first purge passage pressure by the first predetermined amount or more in the comparison, and then to shift the purge control valve and the shutoff valve to the second state; and the control unit is configured to shift the purge control valve and the shutoff valve to a third state with the purge control valve in the opened position and the shutoff valve in the opened position, if the second purge passage pressure is not higher than the first purge passage pressure by the first predetermined amount or more and higher than the first purge passage pressure by the second predetermined amount or more in the comparison.

4. The leakage detector for the fuel vapor treatment device according to claim 1, further comprising an intake passage pressure detector disposed along the intake passage, wherein:

the control unit is configured to compare the intake passage pressure acquired from the intake passage pressure detector with a third purge passage pressure acquired from the purge passage pressure detector after shifting the purge control valve and the shutoff valve to the first state but before shifting the purge control valve and the shutoff valve to the second state; and the control unit is configured to determine the leakage in the purge passage without performing the comparison between the first purge passage pressure and the second purge passage pressure when the third purge passage pressure is higher than the intake passage pressure by an allowable value or more.

* * * * *